US005419681A

United States Patent [19]

Lee

[11] Patent Number: 5,419,681

[45] Date of Patent: May 30, 1995

[54] FILM COOLED WALL

[75] Inventor: Ching-Pang Lee, Cincinnati, Ohio

[73] Assignee: General Electric Company, Cincinnati, Ohio

[21] Appl. No.: 12,493

[22] Filed: Jan. 25, 1993

[51] Int. Cl.[6] ..... F01D 5/18; F02G 3/00

[52] U.S. Cl. ..... 416/97 R; 415/115; 60/757

[58] Field of Search ..... 416/96 R, 97 R; 60/752, 60/754, 755, 756, 757; 415/115, 116

[56] References Cited

U.S. PATENT DOCUMENTS

| | | | |
|---|---|---|---|
| 2,785,878 | 3/1957 | Conrad | 60/754 |
| 4,197,443 | 4/1980 | Sidenstick . | |
| 4,303,374 | 12/1981 | Braddy . | |
| 4,380,905 | 4/1983 | Smart et al. | 60/756 |
| 4,485,630 | 12/1984 | Kenworthy | 60/757 |
| 4,653,983 | 3/1987 | Vehr . | |
| 4,664,597 | 5/1987 | Auxier et al. . | |
| 4,669,957 | 6/1987 | Phillips et al. . | |
| 4,672,727 | 6/1987 | Field . | |
| 4,676,719 | 6/1987 | Auxier et al. . | |
| 4,684,323 | 8/1987 | Field . | |
| 4,705,455 | 11/1987 | Sahm et al. . | |
| 4,738,588 | 4/1988 | Field . | |
| 4,762,464 | 8/1988 | Vertz et al. . | |
| 4,827,587 | 5/1989 | Hall et al. | 416/97 R |

FOREIGN PATENT DOCUMENTS

| | | | |
|---|---|---|---|
| 335481 | 10/1989 | European Pat. Off. | 416/97 R |

*Primary Examiner*—Edward K. Look
*Assistant Examiner*—James A. Larson
*Attorney, Agent, or Firm*—Jerome C. Squillaro; Bernard E. Shay

[57] ABSTRACT

A wall adapted for use in a gas turbine engine between a first and a hotter second fluid includes a first side over which is flowable the first fluid, and an opposite second side over which is flowable the second fluid. An elongate notch includes a forward surface extending inwardly from the second side and is disposed in flow communication with a plurality of longitudinally spaced apart holes extending inwardly from the first side. The notch also includes an aft surface extending from the forward surface to the wall second side which is inclined at an acute discharge angle relative to the second side. The holes are disposed at an acute discharge angle relative to the second side for discharging the first fluid into the notch, and the notch discharge angle is smaller than the hole discharge angle for discharging the first fluid from the notch along the second side.

8 Claims, 3 Drawing Sheets

FILM COOLED WALL

The present invention relates generally to gas turbine engines, and, more specifically, to film cooling of walls therein such as those found in rotor blades, stator vanes, combustion liners, and exhaust nozzles, for example.

BACKGROUND OF THE INVENTION

Gas turbine engines include a compressor for compressing ambient airflow which is then mixed with fuel in a combustor and ignited for generating hot combustion gases which flow downstream over rotor blades, stator vanes, and out an exhaust nozzle. These components over which flows the hot combustion gases must, therefore, be suitably cooled to provide a suitable useful life thereof, which cooling uses a portion of the compressed air itself bled from the compressor.

For example, a rotor blade or stator vane includes a hollow airfoil the outside of which is in contact with the combustion gases, and the inside of which is provided with cooling air for cooling the airfoil. Film cooling holes are typically provided through the wall of the airfoil for channeling the cooling air through the wall for discharge to the outside of the airfoil at a shallow angle relative to the flow direction of the combustion gases thereover to form a film cooling layer of air to protect the airfoil from the hot combustion gases and for cooling the airfoil. In order to prevent the combustion gases from flowing backwardly into the airfoil through the film holes, the pressure of the cooling air inside the airfoil is maintained at a greater level than the pressure of the combustion gases outside the airfoil to ensure only forward flow of the cooling air through the film holes and not backflow of the combustion gases therein. The ratio of the pressure inside the airfoil to outside the airfoil is conventionally known as the backflow margin which is suitably greater than 1.0 for preventing backflow.

The ratio of the product of the density and velocity of the film cooling air discharged through the film holes relative to the product of the density and velocity of the combustion gases into which the film cooling air is discharged is conventionally known as the film blowing ratio. The film blowing ratio, or mass flux ratio, of the injected film cooling air to the combustion gas flow is a common indicator for the effectiveness of film attachment. Values of the film blowing ratio greater than about 0.7 to 1.5, for example, indicate the tendency for the film cooling air to lift off the surface of the airfoil near the exit of the film cooling hole, which is conventionally known as blow-off. Effective film cooling requires that the film cooling air be injected in a manner which allows the cooling air to adhere to the airfoil outside surface, with as little mixing as possible with the hotter combustion gases.

One conventionally known method to aid in obtaining effective film cooling is to inject the cooling air at a shallow angle relative to the outside surface to reduce blow-off tendency. The blow-off of film cooling air increases mixing with the hotter gases to varying extents, depending upon the severity of the blow-off. This results in a decrease in the effectiveness of the film cooling air and, therefore, decreases the performance efficiency of the cooling air which, in turn, reduces the overall efficiency of the gas turbine engine.

Another common indicator of film effectiveness is the film coverage. The coverage is generally known as the fractional amount of the airfoil outside surface which is thought to have film injected over it, at the exit of a row of film cooling holes. An increased coverage generally, but not necessarily, means an increased film effectiveness. The maximum coverage which may be obtained for a single configuration of film cooling is 1.0.

In order to reduce the film blowing ratio, it is known to provide tapered film cooling holes which reduce the velocity of the film cooling air as it flows therethrough by the conventionally known diffusion process for improving the effectiveness of the film cooling air discharged from the hole. It is also conventionally known to provide a longitudinally extending slot in the airfoil wall which is disposed perpendicularly relative to the direction of the combustion gases, with the slot being fed by a plurality of longitudinally spaced apart film cooling metering holes. The slot provides a plenum of increased area relative to the collective area of the metering holes which, therefore, reduces the velocity of the film cooling air therein by diffusion prior to discharge from the slot along the wall outer surface. In addition, the provision of a slot and the effective diffusion of cooling air within this slot serves to increase the film coverage as the cooling air exits onto the airfoil outside surface.

Various embodiments of film cooling holes feeding diffusion holes or slots are known and have varying degrees of complexity, and, therefore, require relatively complex fabrication processes which increases manufacuting costs which can be substantial for mass produced components such as turbine vanes and blades. Furthermore, it is desirable to have shallow injection angles down to about 15°, but such small angles formed at the film cooling holes reduces the strength of the hole at this location and requires more precise manufacturing to obtain.

SUMMARY OF THE INVENTION

A wall adapted for use in a gas turbine engine between a first and a hotter second fluid includes a first side over which is flowable the first fluid, and an opposite second side over which is flowable the second fluid. An elongate notch includes a forward surface extending inwardly from the second side and is disposed in flow communication with a plurality of longitudinally spaced apart holes extending inwardly from the first side. The notch also includes an aft surface extending from the forward surface to the wall second side which is inclined at an acute discharge angle relative to the second side. The holes are disposed at an acute discharge angle relative to the second side for discharging the first fluid into the notch, and the notch discharge angle is smaller than the hole discharge angle for discharging the first fluid from the notch along the second side.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DESCRIPTION OF THE PREFERRED EMBODIMENT(S)

Figure 1:
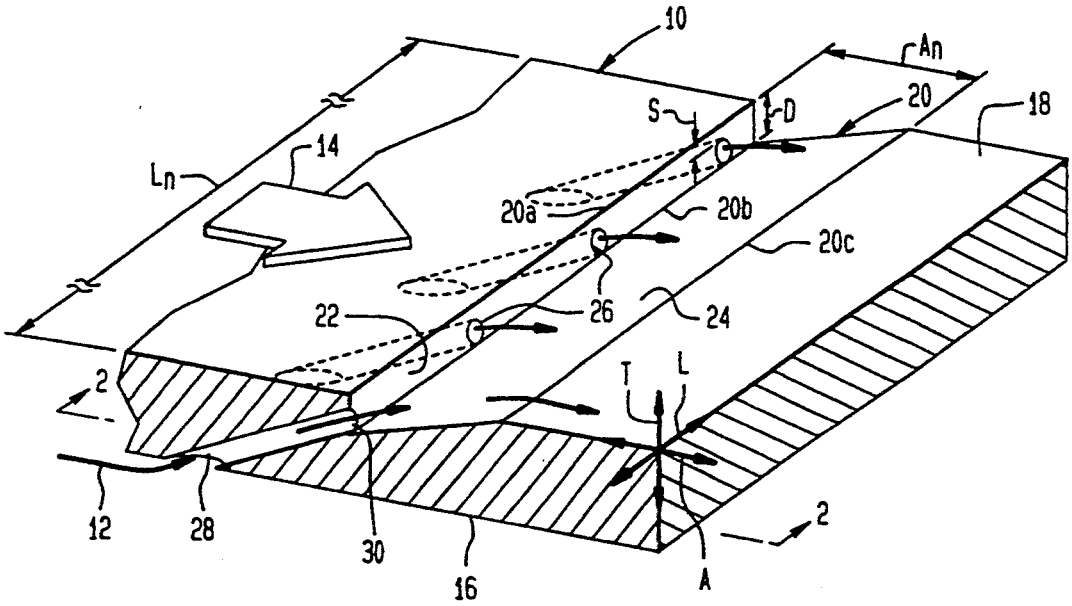
FIG. 1 is a schematic, partly sectional perspective view of an exemplary wall having a notch disposed in flow communication with a plurality of holes for providing film cooling.

Illustrated schematically in FIG. 1 is a wall 10 adaptable for use in a gas turbine engine (not shown) between a first, or relatively cold, fluid 12 and a second, or relatively hot, fluid 14, which is hotter than the first fluid 12. In the application of a gas turbine engine, the first fluid 12 will typically be a portion of compressed air bled from the compressor of the gas turbine engine, and the second fluid 14 will be the hot combustion gases generated in the combustor thereof.

The wall 10 includes a first side, or inner surface, 16 configured for facing the first fluid 12, and over which is flowable the first fluid 12. The wall 10 also includes an opposite, second side, or outer surface, 18 which is configured for facing the second fluid 14 and over which is flowable the second fluid 14 in a downstream direction thereover. The downstream direction is defined herein as an axial axis A relative to the second side 18 for indicating the predominant direction of flow of the second fluid 14 over the second side 18. The second side 18 is spaced from the first side 16 along a transverse axis T which is disposed perpendicularly to the axial A-axis.

The wall 10 further includes an elongate recess or notch 20 extending partly inwardly along the transverse T-axis from the second side 18 toward the first side 16 and longitudinally along a longitudinal axis L disposed perpendicularly to both the transverse T-axis and the axial A-axis. The notch 20 has a transverse depth D, axial width $A_n$, and longitudinal length $L_n$ which are conventionally determined for each design application.

Figure 2:
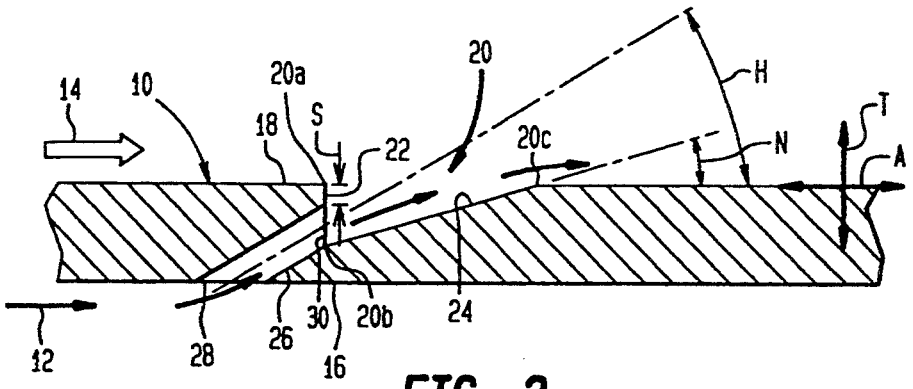
FIG. 2 is a transverse sectional view of the wall illustrated in FIG. 1 taken along line 2-2.

Referring again to FIG. 1, the notch 20 is defined by a preferably flat, forward, or upstream, surface 22 extending transversely from the second side 18 at a notch leading edge 20*a* toward the first side 16, and a preferably flat aft, or downstream, surface 24 extending axially downstream from a notch joining edge 20*b* with the forward surface 22 to the second side 18 at a notch trailing edge 20*c* thereon. As shown in FIG. 2, the notch forward and aft surfaces 22, 24 intersect each other along the joining edge 20*b* at an acute angle, with the notch aft surface 24 being inclined at an acute notch discharge angle N relative to the second side 18 at the notch trailing edge 20*c*.

The wall 10 further includes a plurality of longitudinally spaced apart metering holes 26 extending inwardly to the first side 16 from the notch forward surface 22 in flow communication with the notch 20 for channeling thereto the first fluid 12. In this exemplary embodiment, the holes 26 are cylindrical and have a diameter and a length which are conventionally selected for each design application for channeling the first fluid 12 into the notch 20. Each hole 26 includes an inlet 28 on the first side 16, and an outlet 30 at its opposite end for discharging the first fluid 12 into the notch 20.

In accordance with one embodiment of the present invention and as shown in FIGS. 1 and 2, each of the holes 26 is inclined at an acute hole discharge angle H relative to the axial A-axis or the second side 18 for discharging the first fluid 12 into the notch 20 along the notch aft surface 24 and from the notch trailing edge 20*c* along the second side 18 into the second fluid 14 for film cooling the wall second side 18.

More specifically, the centerline of each hole 26 is inclined relative to the wall second side 18 at the acute hole discharge angle H as shown in FIG. 2, with the notch discharge angle N being less than the hole discharge angle H. In this way, the first fluid 12 is initially discharged from the holes 26 at the hole discharge angle H, and then is allowed to diffuse both laterally along the longitudinal L-axis (see FIG. 1) as well as axially along the axial A-axis; with the first fluid 12 then being discharged from the notch 20 along its trailing edge 20*c* at a more shallow discharge angle, i.e. notch discharge angle N, for reducing the blow-off tendency and improving formation of the cooling film extending downstream from the notch trailing edge 20*c*.

As shown in FIGS. 1 and 2, the notch forward and aft surface 22, 24 are each preferably substantially flat and join together at the joining edge 20*b* to define a generally V-shaped notch 20 opening outwardly from the wall second side 18 toward the second fluid 14 without obstruction. The notch forward wall 22 is disposed substantially perpendicularly to the wall second side 18 to provide a zone protected from the second fluid 14 into which the first fluid 12 may be injected from the holes 26. And, as the first fluid 12 passes through the notch 20, it diffuses in three directions along the A, T, and L-axes as it flows outwardly to meet the second fluid 14 flowing axially along the wall second side 18 and over the notch 20.

In a preferred embodiment, the hole discharge angle H is about 30°, and the notch discharge angle N is in a range of about 15°–20°. Accordingly, the notch aft surface 24 is further inclined relative to the holes 26 to provide a relatively shallow discharge angle (i.e. N) at the notch trailing edge 20*c* without the need to similarly incline the holes 26 at such shallow angles.

It is to be noted that if the holes 26 were inclined at small discharge angles H in the range of 15°–20°, correspondingly small angles would be formed in the wall 10 where the holes discharge to the wall second side 18. Such small angles are difficult to accurately form during manufacture and would typically leave relatively thin wall material subject to easy damage and wear during operation.

In contrast, by inclining the holes 26 at about 30° to the wall second side 18, increased material remains at the junction therewith to improve ease of manufacture and reduce potential damage thereto during operation. In a preferred embodiment as shown in FIGS. 1 and 2, the holes 26 at their outlets 30 are spaced inwardly from the notch leading edge 20*a* in the notch forward surface 22 at a finite spacing S to prevent the formation of a sharp corner thereat which would otherwise have an included angle equal to the hole discharge angle H. The spacing S may be selected as desired to form a generally square corner of about 90° at the notch leading edge 20*a* instead of an acute corner thereat with the small hole discharge angle H, e.g. 30° or smaller.

Accordingly, the notch 20 described above is relatively simple in structure yet effective to increase diffusion and decrease blow-off tendency while maintaining structural strength without sharp corners. And, since the notch 20 has essentially a two-dimensional shape in the T and A-axes plane and continues substantially identically along the L-axis, it may be readily manufactured at reduced cost by firstly casting or machining the notch 20 in the wall 10, and then forming the holes 26 through the wall 10 from the forward surface 22 by conventional drilling.

Figure 3:
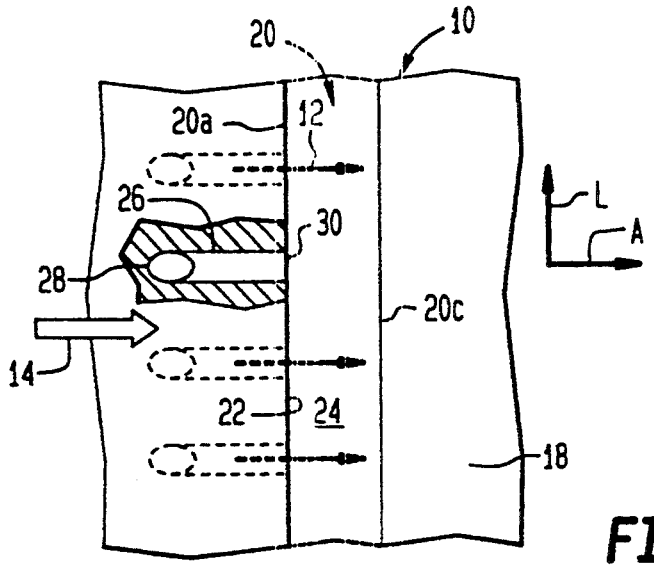
FIG. 3 is a top view of the wall illustrated in FIGS. 1 and 2.

As additionally shown in FIG. 3, the holes 26 are preferably disposed parallel to each other, and parallel to the axial A-axis for discharging the first fluid 12 into the notch 20 substantially parallel to the second fluid 14 flowable over the wall second side 18.

Figure 4:
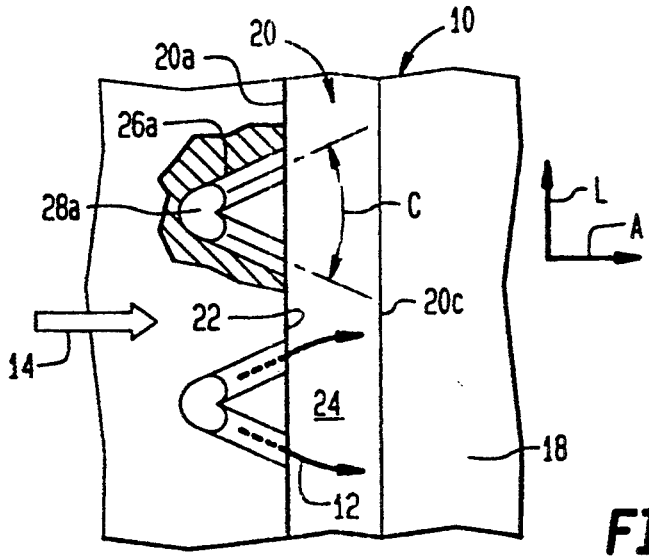
FIG. 4 is a top view of a notched wall in accordance with a second embodiment of the present invention.

In alternate embodiments, the holes 26, designated **26*a* and shown in FIG. 4, may be grouped in pairs intersecting at a common inlet 28*a* and diverging apart at an acute angle C to longitudinally spread the injected first fluid 12 into the notch 20**.

Figure 5:
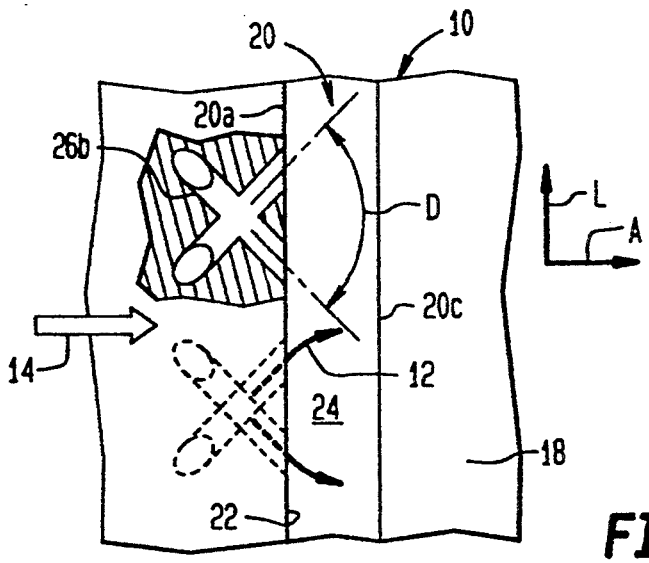
FIG. 5 is a top view of a notched wall in accordance with a third embodiment of the present invention.

In an alternate embodiment illustrated in FIG. 5, the holes 26, designated **26*b*, are again grouped in pairs, with each pair intersecting at their mid-sections and again diverging at an acute angle D to spread the first fluid 12 in the notch 20**.

Figure 6:
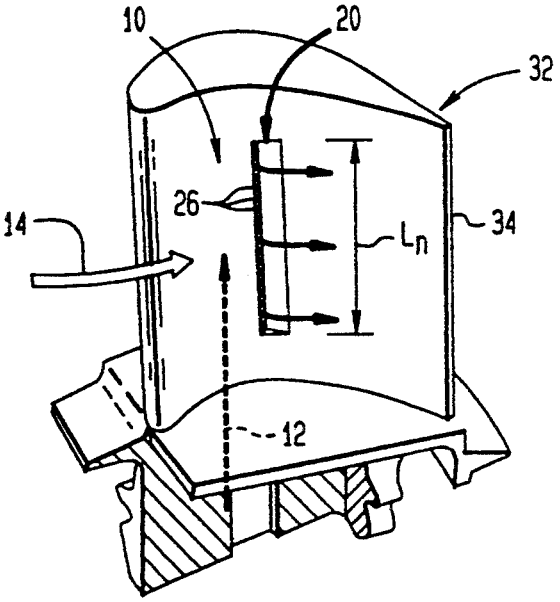
FIG. 6 is one embodiment of the wall of the present invention disposed in an airfoil of a gas turbine engine rotor blade.

The wall 10 described above may be adapted for use in a conventional gas turbine engine wherever suitable for providing improved film cooling. For example, FIG. 6 illustrates an otherwise conventional gas turbine engine turbine rotor blade 32 conventionally joinable to a disk (not shown) and over which the second fluid 14, in the form of combustion gases, flows for rotating the disk for generating shaft power. The blade 32 includes a conventional airfoil 34 having conventional pressure and suction sides, and the wall 10 forms the pressure side of the airfoil 34 in this exemplary embodiment. The notch 20 extends longitudinally in a conventional radial direction of the blade 32 and perpendicularly to the flow of the second fluid 14 which flows generally axially over the wall 10. The notch 20 faces outwardly from the wall 10, and the holes 26 (see FIG. 1) face inwardly into the airfoil 34. The airfoil 34 is conventionally hollow for channeling therethrough in a conventional manner the first fluid 12 which is a portion of compressor air for flow into the holes 26 and in turn through the notch 20 to film cool the airfoil 34 from heating by the second fluid 14, or combustion gases, flowable thereover.

Figure 7:
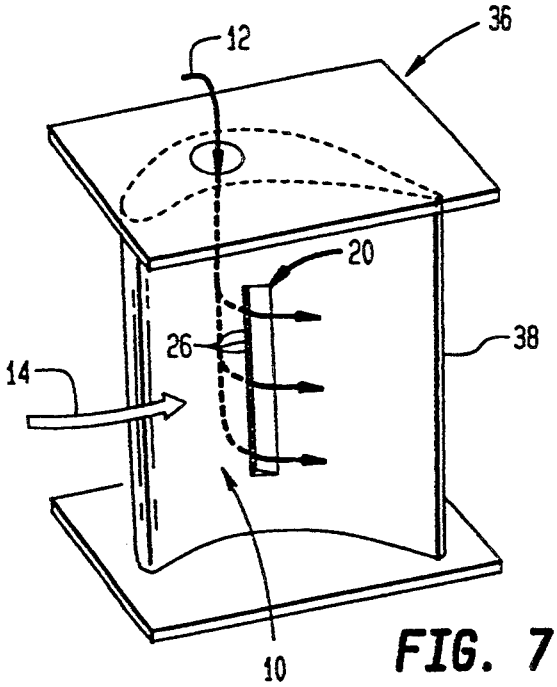
FIG. 7 is another embodiment of the wall of the present invention disposed in an airfoil of a gas turbine engine stator vane.

Similarly, FIG. 7 illustrates schematically an otherwise conventional gas turbine engine stator vane 36 having a hollow airfoil 38 through which is conventionally channeled the first fluid 12 and over which is channeled the second fluid 14. The wall 10 similarly forms the concave side of the airfoil 38 in this exemplary embodiment, and the notch 20 thereof also extends radially upwardly for providing film cooling of the airfoil 38 from heating by the second fluid 14 flowable thereover.

Figure 8:
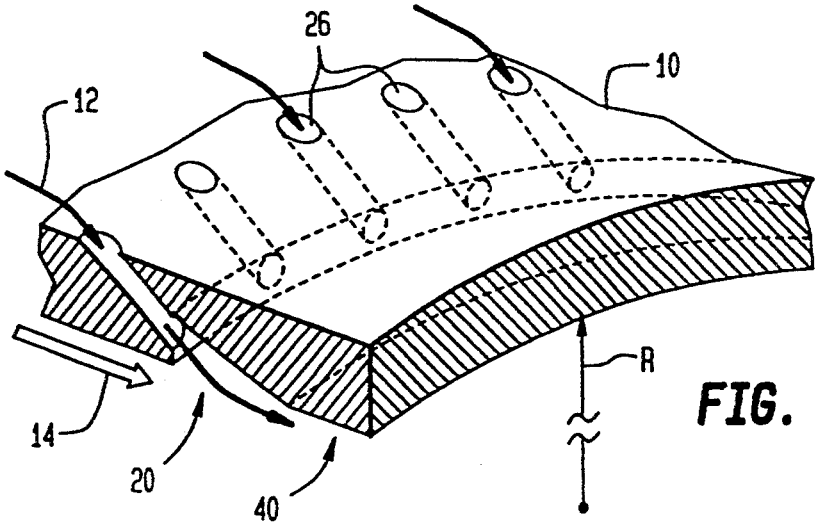
FIG. 8 is another embodiment of the wall of the present invention in the form of a liner for a gas turbine engine combustor or exhaust nozzle.

FIG. 8 illustrates another embodiment of the wall 10 which is a portion of a flat or annular (radius R) liner 40 of a combustor or exhaust nozzle which confines combustion gases such as the second fluid 14. The notch 20 in this embodiment faces radially inwardly toward the second fluid 14 and extends circumferentially around the liner 40 about the axial centerline axis thereof and perpendicularly to the axial flow of the second fluid 14 radially inside the liner 40. The holes 26 face radially outwardly and are spaced circumferentially around the liner 40 for receiving the first fluid 12 from outside the liner 40. In this way, more effective film cooling of the liner 40 may be provided. And, as typically found in combustion liners, axially spaced apart rows of the notches 20 and cooperating holes 26 may be provided for re-energizing the film cooling layer for the entire axial extent of the liner 40.

The wall 10 as described above may be used for other components in a gas turbine engine wherever film cooling is desired. The holes 26 and notch 20 provide a new arrangement for providing improved film cooling of the wall 10 in any suitable component.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims:

1. A wall adaptable for use in a gas turbine engine between a first fluid and a second fluid being hotter than said first fluid, comprising:

a first side over which is flowable said first fluid:

an opposite second side spaced from said first side along a transverse axis and over which is flowable said second fluid in a downstream direction along an axial axis disposed perpendicularly to said transverse axis;

an elongate notch extending partly inwardly along said transverse axis from said second side toward said first side and longitudinally along a longitudinal axis disposed perpendicularly to both said transverse axis and said axial axis, said notch being defined by a forward surface extending transversely from said second side at a notch leading edge toward said first side, and by an aft surface extending axially downstream from a notch joining edge with said forward surface to said second side at a notch trailing edge, said notch aft surface being inclined at an acute notch discharge angle relative to said second side at said notch trailing edge;

a plurality of longitudinally spaced apart holes extending inwardly to said first side from said notch forward surface in flow communication with said notch for channeling thereto said first fluid; and said holes being inclined at an acute hole discharge angle relative to said second side for discharging said first fluid into said notch along said notch aft surface, and from said notch trailing edge along said second side into said second fluid for film cooling said wall second side, with said notch discharge angle being less than said hole discharge angle;

wherein said first and second sides are generally parallel to each other, and said notch forward surface extends substantially perpendicularly to said second side at said notch leading edge to protect said first fluid from said second fluid as said first fluid discharges from said holes into said notch;

wherein said holes are spaced inwardly from said notch leading edge in said notch forward surface to prevent the formation of a sharp corner thereat, thereby reducing the potential for damaging said wall during operation of said engine.

2. A wall according to claim 1 wherein said notch forward and aft surfaces are substantially flat and join together at said joining edge to define a generally V-shaped notch opening outwardly from said wall second side without obstruction.

3. A wall according to claim 2 wherein said holes are disposed parallel to each other and each of said holes has a generally elliptically shaped inlet formed in said first side.

4. A wall according to claim 3 wherein said holes are disposed parallel to said axial axis for discharging said cooling air into said notch substantially parallel to said second fluid flowable over said wall second side.

5. A wall according to claim 2 wherein said hole discharge angle is about 30° for allowing said first fluid to diffuse within said notch and for facilitating the manufacture of said holes, and said notch discharge angle is in a range of about 15°–20° for reducing the blow-off tendency of said first fluid.

6. A wall according to claim 5 wherein:

said wall is a portion of a gas turbine engine airfoil;

said notch extends in a radial direction perpendicularly to flow of said second fluid over said wall and faces outwardly, with said holes facing inwardly into said airfoil; and said airfoil is hollow for channeling therethrough said first fluid into said holes for flow through said notch to film cool said airfoil from heating by said second fluid flowable thereover.

7. A wall according to claim 2 wherein:

said wall is a portion of a gas turbine engine airfoil;

said notch extends in a radial direction perpendicularly to flow of said second fluid over said wall and faces outwardly, with said holes facing inwardly into said airfoil; and said airfoil is hollow for channeling therethrough said first fluid into said holes for flow through said notch to film cool said airfoil from heating by said second fluid flowable thereover.

8. A wall according to claim 2 wherein:

said wall is a portion of an annular gas turbine engine liner;

said notch faces radially inwardly and extends circumferentially around said liner and perpendicularly to an axial flow of said second fluid radially inside said liner; and said holes face radially outwardly and are spaced circumferentially around said liner for receiving said first fluid from outside said liner.

* * * * *